US009987197B2

(12) United States Patent
Itzek

(10) Patent No.: US 9,987,197 B2
(45) Date of Patent: Jun. 5, 2018

(54) TEAT

(71) Applicant: MAPA GmbH, Zeven (DE)

(72) Inventor: Eckhard Itzek, Gyhum-Nartum (DE)

(73) Assignee: MAPA GMBH, Zeven (DE)

( * ) Notice: Subject to any disclaimer, the term of this patent is extended or adjusted under 35 U.S.C. 154(b) by 0 days. days.

(21) Appl. No.: 14/383,778

(22) PCT Filed: Mar. 11, 2013

(86) PCT No.: PCT/EP2013/000709

§ 371 (c)(1),
(2) Date: Sep. 8, 2014

(87) PCT Pub. No.: WO2013/131660

PCT Pub. Date: Sep. 12, 2013

(65) Prior Publication Data

US 2015/0142054 A1 May 21, 2015

(30) Foreign Application Priority Data

Mar. 9, 2012 (DE) ..... 20 2012 002 302 U

(51) Int. Cl.
*A61J 11/00* (2006.01)
*A61J 17/00* (2006.01)

(52) U.S. Cl.
CPC ..... *A61J 11/006* (2013.01); *A61J 11/0035* (2013.01); *A61J 17/001* (2015.05)

(58) Field of Classification Search
CPC ..... A61J 17/00; A61J 17/02; A61J 2017/001; A61J 11/00; A61J 11/0035; A61J 11/004; A61J 11/0045; A61J 11/005; A61J 11/0055; A61J 11/006; A61J 11/0065; A61J 11/007
See application file for complete search history.

(56) References Cited

U.S. PATENT DOCUMENTS

| | | | | |
|---|---|---|---|---|
| 2,520,733 | A | 8/1950 | Muller | |
| 2004/0220618 | A1* | 11/2004 | Rohrig | 606/234 |
| 2009/0039046 | A1* | 2/2009 | Marr | A61J 11/0015 215/11.4 |
| 2011/0130791 | A1* | 6/2011 | Marr | A61J 17/001 606/236 |

FOREIGN PATENT DOCUMENTS

| | | |
|---|---|---|
| CN | 101711150 | 5/2010 |
| DE | 9415655 | 11/1994 |
| DE | 202004005564 | 6/2004 |
| DE | 10 2007 027 960 A1 | 12/2008 |
| EP | 0026802 A1 | 4/1981 |
| RU | 33318 U1 | 10/2003 |
| WO | 2008154968 | 12/2008 |
| WO | 2008154986 | 12/2008 |

* cited by examiner

*Primary Examiner* — Diane Yabut
(74) *Attorney, Agent, or Firm* — Eversheds Sutherland (US) LLP

(57) ABSTRACT

A teat with a base and a hollow and flexible mouthpiece protruding from it with a palate contact area, characterized in that the mouthpiece has a planar thinning area fully or partially extending over the palate contact area, in which the mouthpiece has a smaller wall thickness than in its adjacent areas.

20 Claims, 3 Drawing Sheets

TEAT

CROSS-REFERENCE TO RELATED APPLICATIONS

This is a national stage application of PCT/EP2013/000709, filed on Mar. 11, 2013, which claims priority to DE 20 2012 002 302.0, filed on Mar. 9, 2012

STATEMENT REGARDING FEDERALLY SPONSORED RESEARCH

Not applicable.

BACKGROUND OF THE INVENTION

The invention relates to a teat, especially for use by babies or small children. The teat can also be designed as a bottle teat or as a pacifier.

Conventional teats have a base and a hollow and elastic mouthpiece protruding from it. In the case of a bottle teat, the mouthpiece has at least one drink opening and the base is provided with a circumferential flange or fastening ring for releasable fastening on a bottle. Bottle teats also usually have an integrated ventilation valve, which enables pressure equalization with the surroundings. It is also known to form the ventilation valve in the contact area between the flange and the opening edge of the bottle. In a pacifier, the base is a mouth shield, via which the teat is supported on the lips and mouth area of the child.

WO 2008/154 968 A1 describes a teat with a nipple support and a hollow teat protruding from the nipple support, which has areas with a smaller wall thickness at least on two opposite-lying longitudinal sides. Due to these thinnings, the teat is flexible and exerts less pressure on the jaw during use. Moreover, the teat is provided with additional, strip-like areas with a smaller wall thickness, which progress at a distance from the middle plane of the nipple shaft approximately parallel to the areas with a smaller wall thickness and continue up to into the area of the nipple head. The deformation of the nipple head is facilitated through a controlled buckling in the strip-like areas with the smaller wall thickness.

DE 20 2004 005 564 U1 describes a bottle teat with a mouthpiece and a dome-shaped support of the mouthpiece called an areola part, wherein the support has a flexible area, which enables a bending of the mouthpiece towards the support and away from the support. The flexible area is formed on the inside of the support by several channels surrounding the axis of the mouthpiece.

Based on this, an object of the invention is to provide a teat, the use of which by a child is considered more pleasant.

BRIEF SUMMARY OF THE INVENTION

The teat according to the invention has a base and a hollow and flexible mouthpiece with a palate contact area, characterized in that the mouthpiece has a two-dimensional thinning area fully or partially extending over the palate contact area, in which the mouthpiece has a smaller wall thickness than in its adjacent areas.

During use, the teat according to the invention rests with the thinning two-dimensional (planar) area on the palate. The thinning area is particularly soft and supple. This is based on the two-dimensional design of the thinning area, which, in contrast to the initially named, strip-like further material weakening, does not surround the palate contact area on the outside, but rather covers it in a planar manner. Due to the softness and suppleness of the thinning area, the use of the teat by a child is considered particularly pleasant. This is also due to the fact that the palate includes particularly pressure-sensitive areas. This is the case in particular in the front area of the hard palate, in particular in the area of the incisive papilla which is a small elevation on the front end of the palate. According to a preferred embodiment, the two-dimensional thinning area is thus located in a palate contact area, which comes in contact with the front area of the hard palate during use. The two-dimensional thinning area is preferably located in a palate contact area of the teat, which comes in contact with the incisive papilla during use. The thinning area is preferably a cohesive thinning area. Over its entire surface, the thinning area preferably has a wall thickness that is reduced with respect to the wall thickness of the adjacent area of the mouthpiece. But the thinning area can also consist of small surface elements arranged next to each other, in which the mouthpiece has a reduced wall thickness and which together cover a surface that forms the thinning area. In this embodiment, a quasi cohesive two-dimensional thinning area is formed.

According to a preferred embodiment, everywhere outside of the thinning area the mouthpiece has a greater wall thickness than in the thinning area. The mouthpiece outside of the mouthpiece (preferably outside the thinning area) also preferably has the same wall thickness everywhere. The mouthpiece in the thinning area also preferably has the same wall thickness everywhere.

According to a preferred embodiment, the wall thickness of the thinning area is a maximum of 75% of the wall thickness of the adjacent area of the mouthpiece. The wall thickness of the thinning area is also preferably a maximum of 50% of the wall thickness of the adjacent area of the mouthpiece. The wall thickness of the thinning area is also preferably at least 20% of the wall thickness of the adjacent area of the mouthpiece. The wall thickness of the thinning area is also preferably at least 40% of the wall thickness of the adjacent area of the mouthpiece.

According to a further embodiment, the wall thickness of the thinning area is selected from one of the following ranges: 0.5 to 0.75 mm, 0.75 to 1.25 mm, 1.25 to 1.49 mm. The wall thickness of the thinning area is preferably 1 mm.

According to a further embodiment, the wall thickness of the area adjacent to the thinning area is selected from one of the following ranges: 1.26 to 1.5 mm, 1.5 to 1.75 mm, 1.75 to 2.0 mm. The wall thickness of the adjacent area is preferably 1.5 mm.

According to a preferred embodiment, the thinning area is completely surrounded by the palate contact area or is congruent with the palate contact area or encloses the palate contact area. The thinning area can thus extend only over a part of the palate contact area or can be designed congruent with it or can extend over a larger area than the palate contact area of the mouthpiece. A thinning area, which is completely surrounded by the palate contact area, can be concentrated on the areas of the palate contact area that are particularly sensitive. This has the advantage that the mouthpiece is less weakened by the thinning area and is thus more firm than in the case of the two other variants. If the thinning area is congruent with the palate contact area, the teat rests in a particularly soft manner on the palate. This is even more the case in the embodiment in which the thinning area encloses the palate contact area because, upon arrangement of the palate contact area on the palate, the parts of the thinning area surrounding the palate contact area also buckle. The thinning area preferably has a contour which progresses parallel to the contour of the palate contact area or coincides with it.

According to a further embodiment, the teat has a preferred rotational position in the mouth due to its design and the thinning area is only present on the palate contact area of the mouthpiece adjacent to the palate in the preferred rotational position. This enables a restriction of the thinning area, which only slightly reduces the firmness of the mouthpiece.

Alternatively, the teat according to the invention has no preferred rotational position in the mouth. This is given in particular in a teat with a rotationally symmetric shape. In teats with a rotationally symmetric shape, the thinning area is also preferably designed in a rotationally symmetric manner so that it comes to rest on the palate in any rotational position.

According to another embodiment, the mouthpiece has at least in the palate contact area and in the teeth area in each cross-section in the direction of the horizontal axis greater dimensions than in the direction of the vertical axis. The horizontal axis is the axis of the cross-section, which is aligned horizontally during use when the child's body is upright and, in the case of the vertical axis, around the axis of the cross-section, which is aligned vertically during this use. The teat is preferably used in the described alignment due to this cross-sectional shape. According to another embodiment, the cross-section is on top.

According to another embodiment, the mouthpiece has a dome on top for placement on the palate and/or a bevel on the bottom for placement on the tongue and/or a waist for receiving the teeth area adjacent to the base. Such a mouthpiece is described in DE 94 15 655 U1. The terms "on the top" and "on the bottom" also relate to an alignment in the mouth of the child when the child's body is upright, in which the components of the teat arranged on the top are arranged above the components arranged on the bottom. The mentioned embodiments also effectuate a preferred rotational position of the teat in the mouth of the child.

According to another embodiment, the thinning area extends in a vertical longitudinal cut through the mouthpiece from the peak of the dome up to the waist. According to another embodiment, the thinning area rests against the particularly sensitive areas of the palate, in particular on the incisive papilla.

According to another embodiment, the thinning area has an elliptical contour when observed from a position vertically above the mouthpiece. This embodiment takes into account that the particularly sensitive areas of the palate are located on and on both sides next to the median plane, i.e. the plane which divides the body into the right and left half.

According to another embodiment, the main axis of the thinning area is arranged in a vertically aligned middle plane of the bottle teat and the secondary axis of the elliptical contour is arranged perpendicular to the middle plane. When used in the preferred rotational position of the bottle teat, the middle plane falls into the median plane of the body. In the case of this embodiment, the thinning area comes to rest in the particularly sensitive areas of the palate. The main axis is the longer and the secondary axis is the shorter axis of the elliptical contour.

According to another embodiment, the mouthpiece has at least one strip-like reinforcing element surrounding the thinning area. The reinforcing element protects the thinning area from damage or respectively prevents damage to the thinning area from spreading to the rest of the teat. The reinforcing element preferably has a progression, which corresponds with the progression of the contour of the thinning area.

According to a further embodiment, the thinning area or a reinforcing element extends to the insides of the longitudinal-side walls of the mouthpiece when observed from a position perpendicular above the teat.

According to another embodiment, the mouthpiece has additional reinforcing elements on both longitudinal sides, which are distanced from each other in the horizontal direction. The additional reinforcing elements protect the mouthpiece from the particularly high stresses on the longitudinal sides. Furthermore, they can act as hinges, which favor a flat pressing together of the mouthpiece so that the jaw is less strained. According to another embodiment, the reinforcing elements are bulges protruding from the inside of the walls of the mouthpiece. The bulges are preferably designed as one piece with the walls of the mouthpiece. Alternatively, the reinforcing elements and/or the additional reinforcing elements are reinforcing threads or reinforcing strips embedded into the mouthpiece. The reinforcing threads or reinforcing strips consist of a flexible material, which is firmer than the rest of the material of the mouthpiece.

According to another embodiment, the teat is a bottle teat, which has at least one drink opening (e.g. drink hole or drink slit) in or next to the palate contact area and has a hollow, elastic base or a circumferential flange or fastening ring on the base.

According to a preferred embodiment, the drink opening is located in the crown area of the dome of the mouthpiece. According to another embodiment, the drink opening is located outside of the thinning area. A weakening of the thinning area by the drink opening is hereby avoided, which could facilitate damage to the thinning area. According to another embodiment, the drink opening is located outside a reinforcing area around the thinning area. A crack growth starting from the drink opening into the thinning area is hereby avoided. According to another embodiment, the drink hole is located between two reinforcing areas surrounding the thinning area. A crack starting from the drink opening is hereby stopped by the two reinforcing areas.

According to another embodiment, the teat is a pacifier with a base in the shape of a mouth shield. The mouth shield is preferably made of a rigid or elastic plastic. According to another embodiment, the mouth shield is rigid with a flexible coating on at least one side.

For a preferred rotational position of a pacifier, a mouth shield of the pacifier can have a (e.g. oval or butterfly-shaped) contour with a free space for the nose area. For this, the inside of the mouth shield can also be curved so that the mouth shield has a preferred alignment with respect to the lips of the child. A correspondingly designed teat is generally used so that the mouthpiece rests at a certain area on the palate. The thinning area is present on this palate contact area.

According to another embodiment, the mouthpiece is made of silicone, natural rubber or a thermoplastic elastomer and/or the base is made of silicone, natural rubber, a thermoplastic elastomer or a thermoplastic or thermosetting plastic.

According to another embodiment, the teat is fully or partially injection-molded or produced in an immersion process. A teat made of silicone is preferably injection-molded and a teat made of natural rubber is preferably produced in an immersion process.

In the design as a bottle teat, the teat is preferably injection-molded or produced in an immersion process as one piece. In the design as a pacifier, it can also be injection-molded or produced in an immersion process as one piece. Through injection-molding in a multi-component injection molding process, a flexible mouthpiece and a hard or elastic mouth shield can be realized. Alternatively, the mouthpiece is injection-molded or produced in an immersion process separately and is connected with a separately injection-molded mouth shield mechanically and/or through adhesion.

BRIEF DESCRIPTION OF THE SEVERAL VIEWS OF THE DRAWINGS

The invention is explained in greater detail below using the attached drawing of an exemplary embodiment for a bottle teat and an exemplary embodiment for a pacifier. The drawing shows.

DETAILED DESCRIPTION OF THE INVENTION

Figure 5:
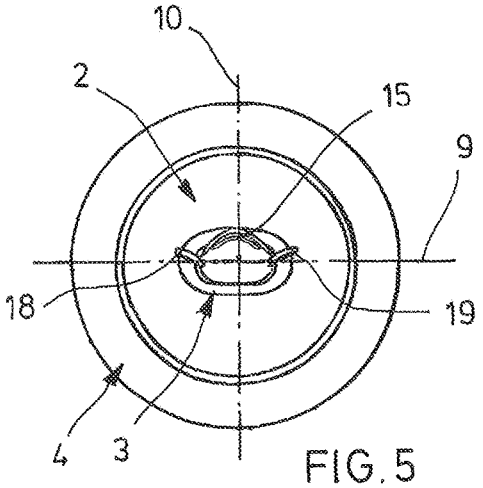
FIG. 5 the bottle teat from the front.

While this invention may be embodied in many different forms, there are described in detail herein a specific preferred embodiment of the invention. This description is an exemplification of the principles of the invention and is not intended to limit the invention to the particular embodiment illustrated.

The teat 1 (also called "bottle teat") has a base 2 in the shape of a hollow dome or bell, which is connected on its tapered end with a hollow mouthpiece 3 and on its large opening with a circumferential, annular-disk-shaped flange 4. The flange 4 is thus called the "proximal end" of the bottle teat and the mouthpiece 3 is also accordingly called the "distal end".

The base 2 of the bottle teat is also called the "body". Below its largest diameter, it has a retracted area 5, which extends up to the inner edge of the flange 4. In the area of the largest diameter, the base 2 has a valve 7 in a recess 6. In the example, the valve 7 is designed as a slit valve with two crossing slits 8.

The mouthpiece 3 is mainly oval in cross-section, wherein the mouthpiece has in each cross-section in the direction of the horizontal axis 9 greater dimensions than in the direction of the vertical axis 10 (see FIG. 5, 6).

Figure 2:
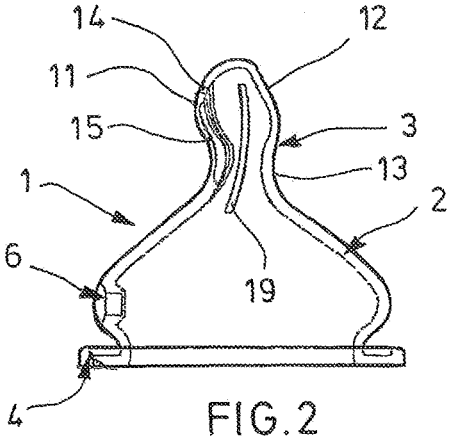
FIG. 2 the bottle teat in a view from the left side.
Figure 1:
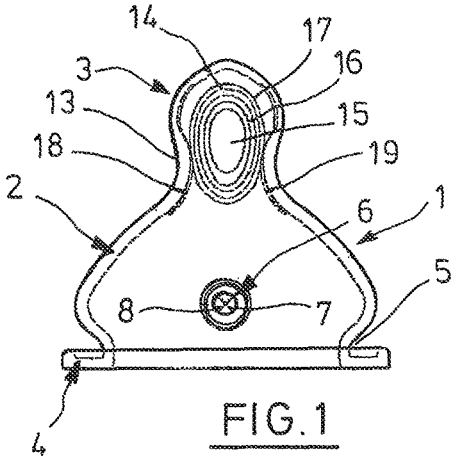
FIG. 1 the bottle teat in a view vertically from the top.
Figure 3:
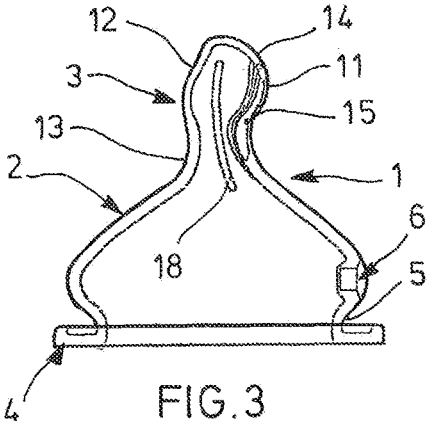
FIG. 3 the bottle teat in a view from the right side.
Figure 6:
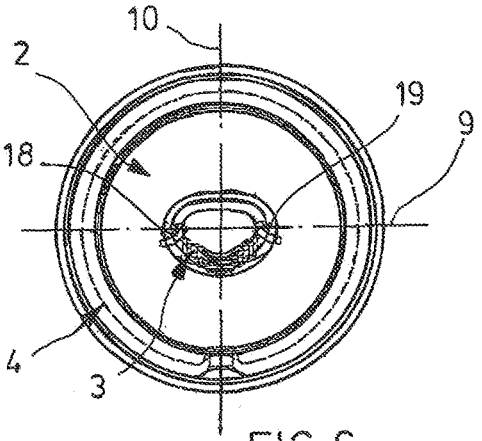
FIG. 6 the bottle teat in a view from behind.
Figure 4:
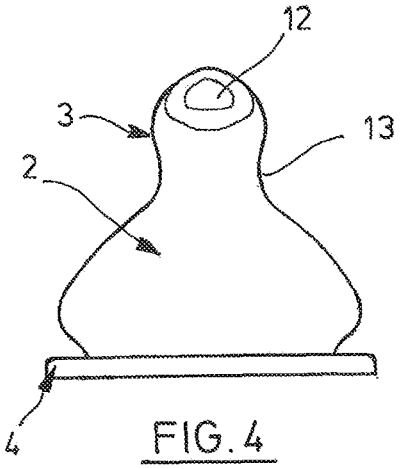
FIG. 4 the bottle teat observed from a direction perpendicular from the bottom.

Furthermore, the mouthpiece 3 has a dome 11 on top for placement on the palate and a bevel 12 on the bottom for placement on the tongue. Moreover, the mouthpiece 3 has a waist 13 adjacent to the base 2. The mouthpiece 3 is wasted in a vertical middle plane (see FIGS. 2, 3 and 7) as well as in a horizontal plane aligned perpendicular to it through its distal end (see FIGS. 1 and 4).

The bevel 12 is mainly even but dented inward slightly.

The bottle teat has a drink hole 14 in the dome 11. This has a cross-section, which tapers from outside to inside. The drink hole is arranged slightly offset with respect to the peak of the dome 11.

Figure 7:
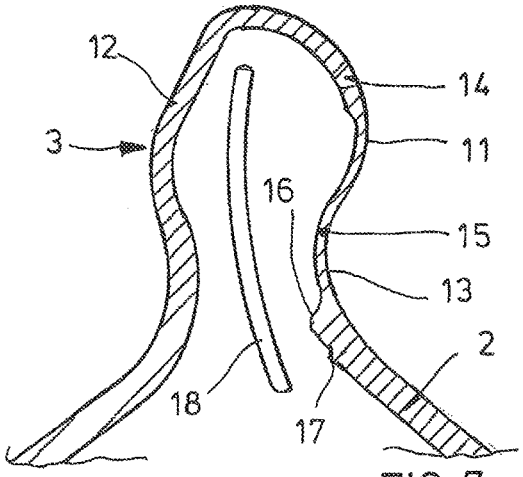
FIG. 7 the bottle teat in an enlarged cut through the median plane.
Figure 8:
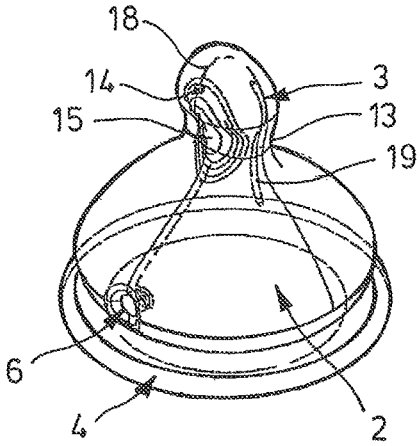
FIG. 8 the bottle teat in a perspective view diagonally from the top and from the left side.

The mouthpiece 3 has a planar thinning area 15 in which its wall thickness is smaller than in the other areas of the mouthpiece 3. The thinning area 15 extends approximately from the crown of the dome 11 over the waist 13 up to the connection of the mouthpiece 3 with the base 2 (FIG. 7). The thinning area 15 is congruent with the palate contact area of the mouthpiece 3.

The thinning area 15 has an elliptical contour. The mouthpiece 3 has reinforcing elements 16, 17 around the thinning area 15, which are designed as bulges, and have an elliptical contour just like the thinning area 15. The reinforcing elements 16, 17 have a small separation distance from each other. The drink hole 14 is located on the vertical middle plane between the reinforcing elements 16, 17.

Furthermore, the bottle teat 1 has two additional reinforcing elements 18, 19 in the shape of bulges, which progress from the inside of the wall of the bottle teat 1 approximately in a horizontal middle plane through the bottle teat. The additional reinforcing elements 18, 19 are slightly curved and thus differ somewhat from the horizontal middle plane (see FIGS. 2, 3 and 7). They extend from the connection area of the mouthpiece 3 with the base 2 up to almost the distal end of the mouthpiece 3.

The teat 1 is made as one piece of silicone, in particular through injection-molding. In a similar design, the bottle teat can also be made of natural rubber.

During use, the flange 4 is screwed onto the edge of the opening of a bottle with fastening thread by means of a fastening ring. The bottle teat is aligned in the mouth of the child so that the dome 11 and the waist with the thinning area 15 rest against the palate, in particular on the incisive papilla. The bevel 12 then rests on the tongue. Due to the soft and supple thinning area 15, use is very pleasant for the child. The reinforcing elements 16, 17, 18, 19 prevent the development and growth of cracks or the like.

In the following description of the pacifier, the same reference numbers are used for components with the same name as in the previous description of the bottle teat.

The pacifier 1 (also called "teat") has a hollow mouthpiece 3. This is shaped orthodontically, i.e. is adapted to the shape of the oral cavity. The mouthpiece 3 has an access hole 20 to a hollow space 21 inside the mouthpiece 3 on the proximal end.

Furthermore, an edge bulge 22 protruding towards the outside surrounds the proximal end.

The mouthpiece 3 has a narrow neck 23 with a waist in the top view and a widened head 24. On the top side, the head 24 has dome 11 arched towards the outside for placement on the palate. On the bottom, it has a bevel 12 for placement on the tongue. The bevel 12 is mainly even but dented inward slightly.

Figure 9:
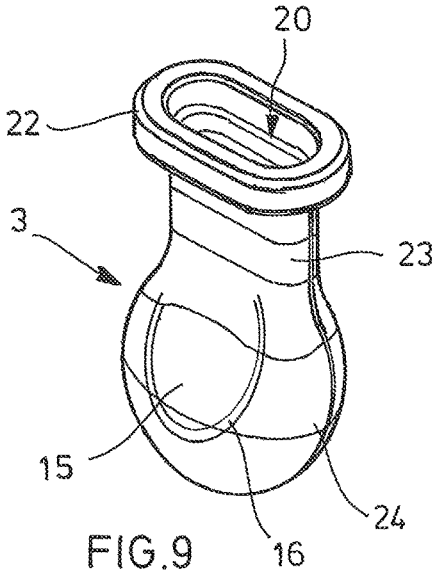
FIG. 9 a mouthpiece of a pacifier in a perspective view diagonally from behind and from the top.
Figure 10:
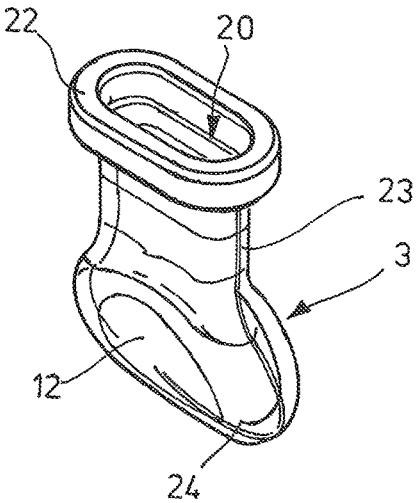
FIG. 10 the mouthpiece in a perspective view diagonally from behind and from the bottom.
Figure 11:
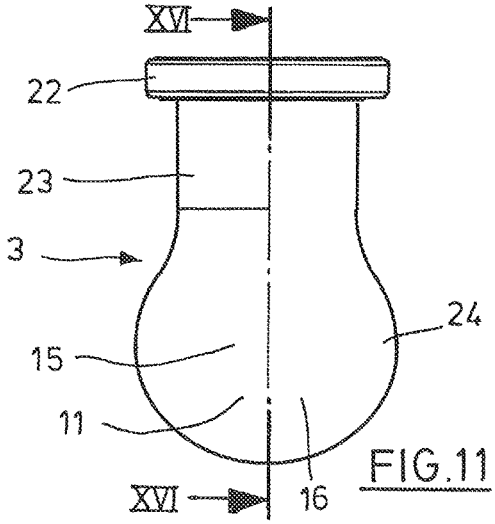
FIG. 11 the mouthpiece in a top view.
Figure 13:
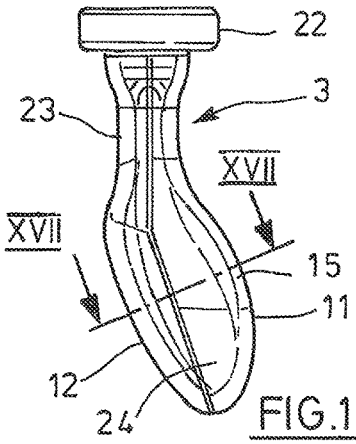
FIG. 13 the mouthpiece in a side view.
Figure 12:
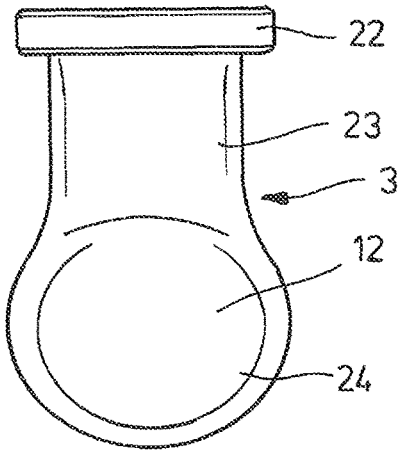
FIG. 12 the mouthpiece in a bottom view.
Figure 14:
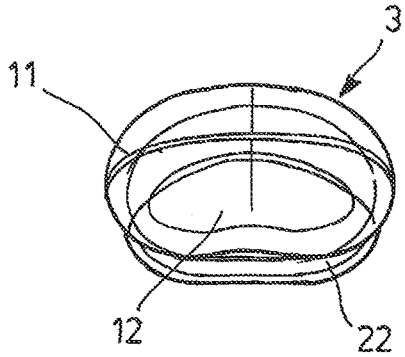
FIG. 14 the mouthpiece in a front view.
Figure 15:
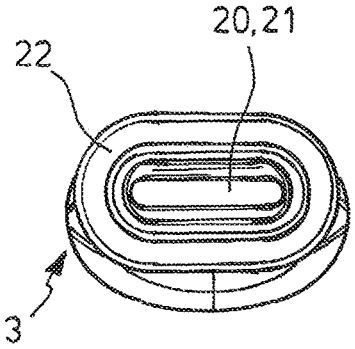
FIG. 15 the mouthpiece in a view from behind.
Figure 16:
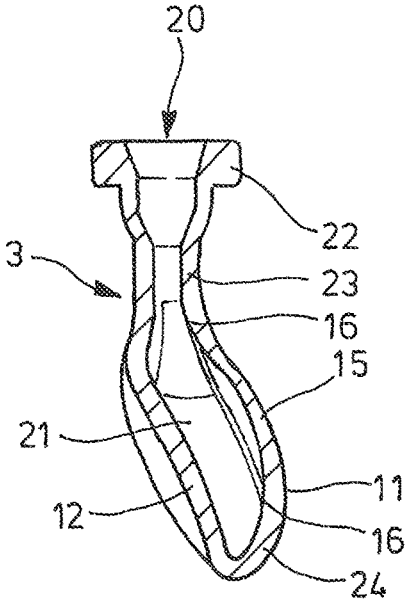
FIG. 16 the mouthpiece in a section along the line XVI-XVI from FIG. 11.
Figure 17:
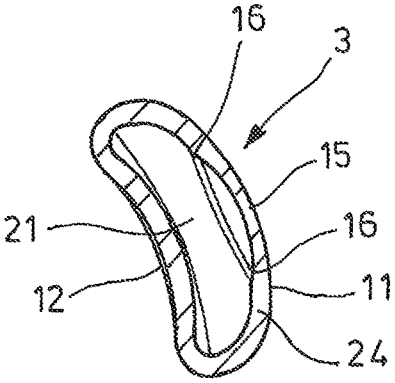
FIG. 17 the mouthpiece in a section along the line XVII-XVII from FIG. 13.

The mouthpiece 3 has a planar thinning area 15 in which its wall thickness is smaller than in the other areas of the mouthpiece 3. The thinning area 15 is designed in the dome 11 of the head 24. The thinning area 15 has an elliptical contour. In the longitudinal direction of the mouthpiece 3, the thinning area 15 extends approximately from the highest point of the dome 11 up to the connection of the head 24 with the neck 23 (see FIG. 13). In the direction perpendicular to the longitudinal axis, the maximum width of the thinning area 15 is approximately one-third to three-fourths, preferably approximately half of the maximum width of the head 24 (see FIGS. 9 and 11).

Around the thinning area 15, the mouthpiece 3 has a reinforcing element 16 in the shape of an inwards-protruding bulge on the inside 3 surrounding the thinning area 15.

The mouthpiece preferably has a wall thickness of approximately 1 mm in the thinning area 15 and a wall thickness of approximately 1.5 mm in the adjacent area. The mouthpiece 3 preferably has a wall thickness of approximately 1.5 mm everywhere outside of the thinning area 15. The mouthpiece 3 preferably has a greater wall thickness in the area of the edge bulge 22.

The mouthpiece 3 is preferably made as one piece of silicone, in particular through injection-molding. In a similar design, the mouthpiece 3 can also be made of natural rubber.

For complete formation of the pacifier 1, the mouthpiece 3 is connected with a mainly rigid shield (also called "mouth shield"). The shield serves for support on the outer mouth area so that the child does not swallow the mouthpiece.

The shield is preferably convex on the inside and arched in a concave manner on the outside so that it rests comfortably on the mouth area of the user.

The shield has a central receiving hole through which the mouthpiece 3 is stuck so that it rests on the outside of the mouth shield with the edge bulge 22 on the edge of the receiving hole. A pin is inserted into the access hole 20 from outside so that the mouthpiece 3 is not pulled out of the receiving hole. The pin is connected as one piece with a button or cover, which is permanently connected (e.g. welded or glued) with the outside of the mouth shield. The pacifier can be gripped from outside on the button in order to insert it into or remove it from the mouth. A cover serves for storage of a ring, which can be used to insert or respectively remove the pacifier in or from the mouth.

A pacifier 1 with mouthpiece 3 (also called "sucking part"), shield, pin and button or respectively cover and ring is described in European standard EN 1400-2:2002, the content of which is hereby incorporated into this application.

If the pacifier 1 with the shield rests on the mouth area and the mouthpiece 3 is arranged in the mouth of the child, the dome 11 with the thinning area 15 rests on the palate, in particular on the incisive papilla. The bevel 12 then rests on the tongue. Due to the soft and supple thinning area 15, use is very pleasant for the child. The reinforcing element 16 prevents the development and growth of cracks or the like.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A teat comprising:

a base comprising a base wall thickness; and a hollow and flexible mouthpiece protruding from said base and having a mouthpiece wall thickness, said mouthpiece comprising:

a palate contact area;

a two-dimensional thinning area fully or partially extending over the palate contact area, said thinning area having a thinning area wall thickness, said thinning area wall thickness having a smaller dimension than said base wall thickness and said mouthpiece wall thickness; and a reinforcing element having at least one elliptical contour, said reinforcing element being disposed along the perimeter of the thinning area.

2. The teat according to claim 1, wherein the thinning area is at least one of completely surrounded by the palate contact area, congruent with the palate contact area, and encloses the palate contact area.

3. The teat according to claim 1, wherein the thinning area is surrounded by the reinforcing element.

4. The teat according to claim 1, wherein the thinning area is only present on the palate contact area of the mouthpiece.

5. The teat according to claim 1, wherein the mouthpiece further comprises a teeth contact area, each of the palate contact area and the teeth contact area having a cross-section dimension that is larger in a direction of a horizontal axis than in a direction of a vertical axis.

6. The teat according to claim 1, wherein the mouthpiece defines a dome diametrically opposed to a waist disposed adjacent to a top end of the base.

7. The teat according to claim 6, wherein the thinning area or a vertical reinforcing element extends in a vertical longitudinal cut through the mouthpiece from a crown of the dome to the waist.

8. The teat according to claim 6, further comprising a drink hole disposed through the mouthpiece adjacent to a crown of the dome.

9. The teat according to claim 6, wherein the dome is asymmetrical along a horizontal axial plane.

10. The teat according to claim 1, wherein the thinning area has an elliptical contour and a main axis of the elliptical contour of the thinning area is arranged in a vertically aligned middle plane of the teat and a secondary axis of the elliptical contour is arranged perpendicular to the middle plane.

11. The teat according to claim 1, wherein the reinforcing element of the mouthpiece further comprises a plurality of reinforcing elements each of the plurality of reinforcing elements defines a bulge that protrudes inwardly from an inside of the wall of the mouthpiece.

12. The teat according to claim 1, further comprising:

at least one drink opening through the mouthpiece in or next to the palate contact area; and an elastic base having a circumferential flange or fastening ring disposed along a bottom end of the base.

13. The teat according to claim 1, wherein the mouthpiece is made of silicone, natural rubber, or a thermoplastic elastomer and/or the base is made of silicone, natural rubber, a thermoplastic elastomer, a thermoplastic, or a thermosetting plastic.

14. The teat according to claim 1, wherein the reinforcing element of the mouthpiece comprises a plurality of reinforcing elements, each of the plurality of reinforcing elements having said elliptical contour, each of the plurality of elliptical contours being concentric relative to each other.

15. The teat according to claim 14, wherein a gap is defined between each adjacent reinforcing element of the plurality of reinforcing elements.

16. The teat according to claim 1, wherein the base comprises a valve having at least one cross slit.

17. The teat according to claim 1, wherein the mouthpiece defines a bevel disposed along a first side of the mouthpiece, wherein the two-dimensional thinning area is disposed along a second side of the mouthpiece opposite the first side.

18. The teat according to claim 1, wherein the mouthpiece defines a bevel diametrically opposed to a waist adjacent to the base.

19. A teat comprising:

a base comprising a base wall thickness;

a hollow and flexible mouthpiece protruding from said base and comprising a mouthpiece wall thickness, said mouthpiece comprising:

a palate contact area;

a two-dimensional thinning area fully or partially extending over the palate contact area, said thinning area comprising a thinning area wall thickness, said thinning area wall thickness having a smaller dimension than said base wall thickness and said mouthpiece wall thickness; and a reinforcing element having an elliptical contour and disposed along the periphery of the thinning area.

20. The teat according to claim 19, wherein the mouthpiece defines a bevel disposed along a first side of the mouthpiece, wherein the two-dimensional thinning area is disposed along a second side of the mouthpiece opposite the first side.

* * * * *